US007390133B2

(12) United States Patent
Hatayama

(10) Patent No.: US 7,390,133 B2
(45) Date of Patent: Jun. 24, 2008

(54) DUPLEX PRINTER INCLUDING PRINT UNIT SHIFTING AND WEB SHIFTING MECHANISMS

(75) Inventor: Fumihiro Hatayama, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 442 days.

(21) Appl. No.: 11/261,523

(22) Filed: Oct. 31, 2005

(65) Prior Publication Data

US 2006/0107855 A1 May 25, 2006

(30) Foreign Application Priority Data

Nov. 19, 2004 (JP) ..... 2004-335326

(51) Int. Cl.
*B41J 3/60* (2006.01)
*B41J 2/01* (2006.01)
*B41J 15/04* (2006.01)

(52) U.S. Cl. ..... 400/149; 400/630; 347/104; 101/484; 101/486

(58) Field of Classification Search ..... 400/149; 101/484, 485, 486; 347/104; *B41J 3/60*
See application file for complete search history.

(56) References Cited

U.S. PATENT DOCUMENTS

| | | | | |
|---|---|---|---|---|
| 5,812,151 | A | 9/1998 | Kishine et al. | |
| 6,050,191 | A * | 4/2000 | Enderle et al. | 101/222 |
| 2002/0105571 | A1 * | 8/2002 | Izawa et al. | 347/104 |
| 2007/0172285 | A1 * | 7/2007 | Izawa et al. | 400/188 |

FOREIGN PATENT DOCUMENTS

| | | |
|---|---|---|
| JP | 08-216467 | 8/1996 |

* cited by examiner

*Primary Examiner*—Leslie J Evanisko
(74) *Attorney, Agent, or Firm*—McDermott Will & Emery LLP

(57) ABSTRACT

After the front surface of a web is printed by a first-side printing unit, the web is shifted in the direction of its width by a direction-changing unit, flipped over by rollers, and transported to a second-side printing unit, where the back surface of the web is printed. A sensor detects a displacement between the second-side printing unit and the web or marks printed on the web. According to the amount and direction of displacement detected by the sensor, a printing unit body is shifted in the direction of the web width, and the web traveling as opposed to the first-side printing unit is shifted in the direction of its width by an edge guide.

8 Claims, 16 Drawing Sheets

DUPLEX PRINTER INCLUDING PRINT UNIT SHIFTING AND WEB SHIFTING MECHANISMS

BACKGROUND OF THE INVENTION

1. Field of the Invention

The present invention relates to a duplex printer for printing on both the front and back sides of a traveling web such as paper or textiles.

2. Description of the Background Art

As duplex printers, a printer as shown in Japanese Patent Application Laid-open No. 8-216467 (1996) is well known.

This printer includes a transport path for transporting a web with the front side up; a reversing unit for reversing a web; and another transport path for transporting a reversed web with the back side up. The printer further includes a printing unit for printing on the front side of a web; and another printing unit for printing on the back side of a web, which is provided separately from the former one.

However, the duplex printer disclosed in Japanese Patent Application Laid-open No. 8-216467 has no control mechanism that allows individual position adjustments between a web and each of the front- and back-side printing units. Thus, if a traveling web moves in zigzag only on either the front- or back-side transport path, it may be difficult to ensure registration accuracy between images printed on the front and back sides of the web.

SUMMARY OF THE INVENTION

The present invention is directed to a duplex printer for printing on both the front and back sides of a traveling web such as paper or textiles.

According to an aspect of the present invention, the duplex printer includes the followings: a first-side printing unit for printing on one side of a traveling web; a second-side printing unit for printing on the other side of the web; a displacement sensor for detecting the amount of displacement between the second-side printing unit and a web which faces the second-side printing unit; a printing-unit shift mechanism for shifting the first-side printing unit and the second-side printing unit integrally in a direction orthogonal to a direction of travel of the web according to the amount of displacement detected by the displacement sensor; and a web control mechanism for shifting a web which faces the first-side printing unit in the direction orthogonal to the direction of travel of the web by an amount corresponding to the amount of shift caused by the printing-unit shift mechanism.

According to another aspect of the present invention, the duplex printer includes the followings: a first-side printing unit for printing on one side of a traveling web; a second-side printing unit for printing on the other side of the web; a displacement sensor for detecting the amount of displacement between the second-side printing unit and a mark printed on the web by the first-side printing unit; a printing-unit shift mechanism for shifting the first-side printing unit and the second-side printing unit integrally in a direction orthogonal to a direction of travel of the web according to the amount of displacement detected by the displacement sensor; and a web control mechanism for shifting a web which faces the first-side printing unit in the direction orthogonal to the direction of travel of the web by an amount corresponding to the amount of shift caused by the printing-unit shift mechanism.

Thus, the duplex printer with the first-side printing unit for printing on one side of a web such as paper or textiles and the second-side printing unit for printing on the other side of the web facilitates correction of zigzag movement of a web or registration on both sides of the web.

It is therefore an object of the present invention to provide a duplex printer that is capable of ensuring registration accuracy between the front and back sides of a web even with zigzag movement of the web.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
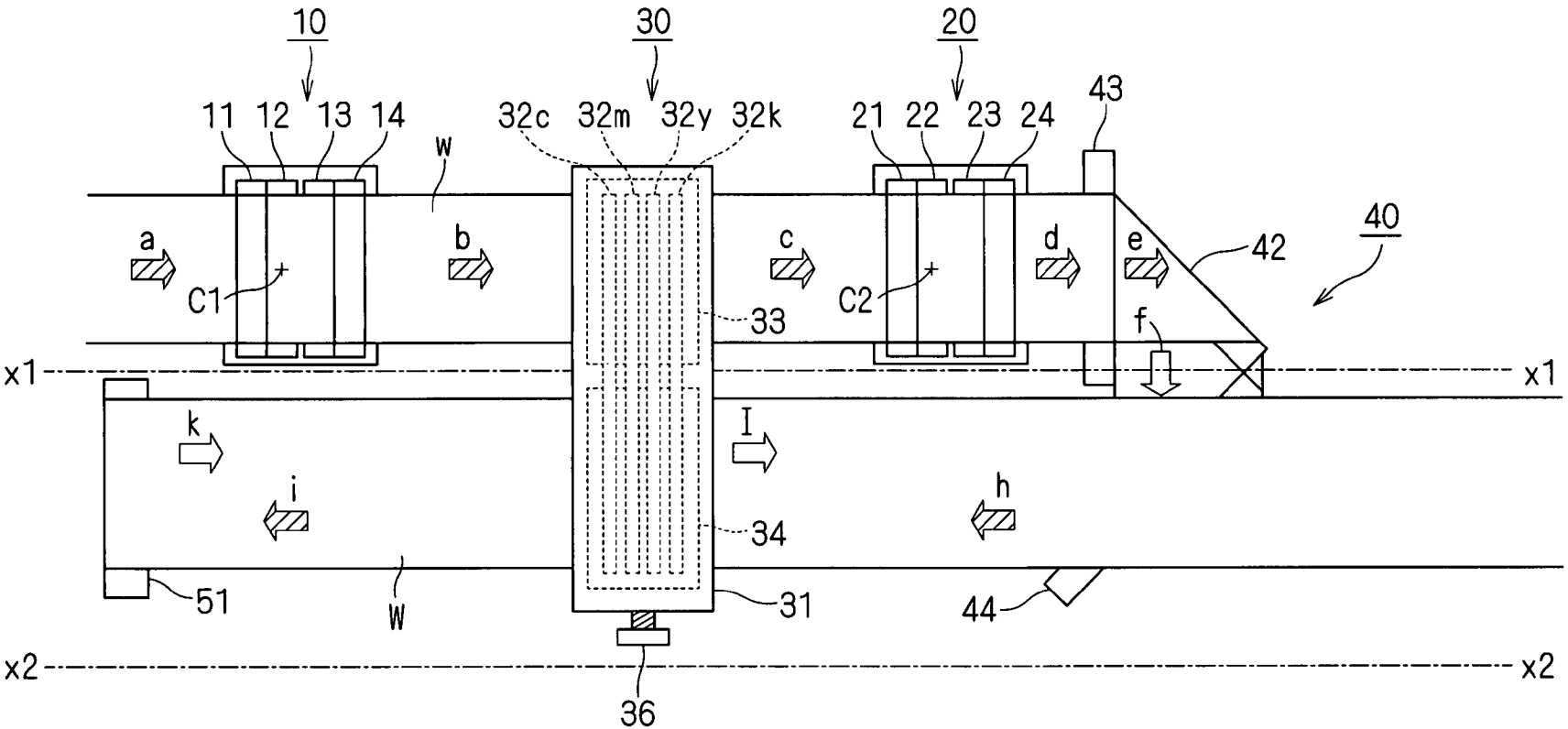
FIG. 1 is a top view of an ink jet printer according to a first preferred embodiment of the present invention.
Figure 2:
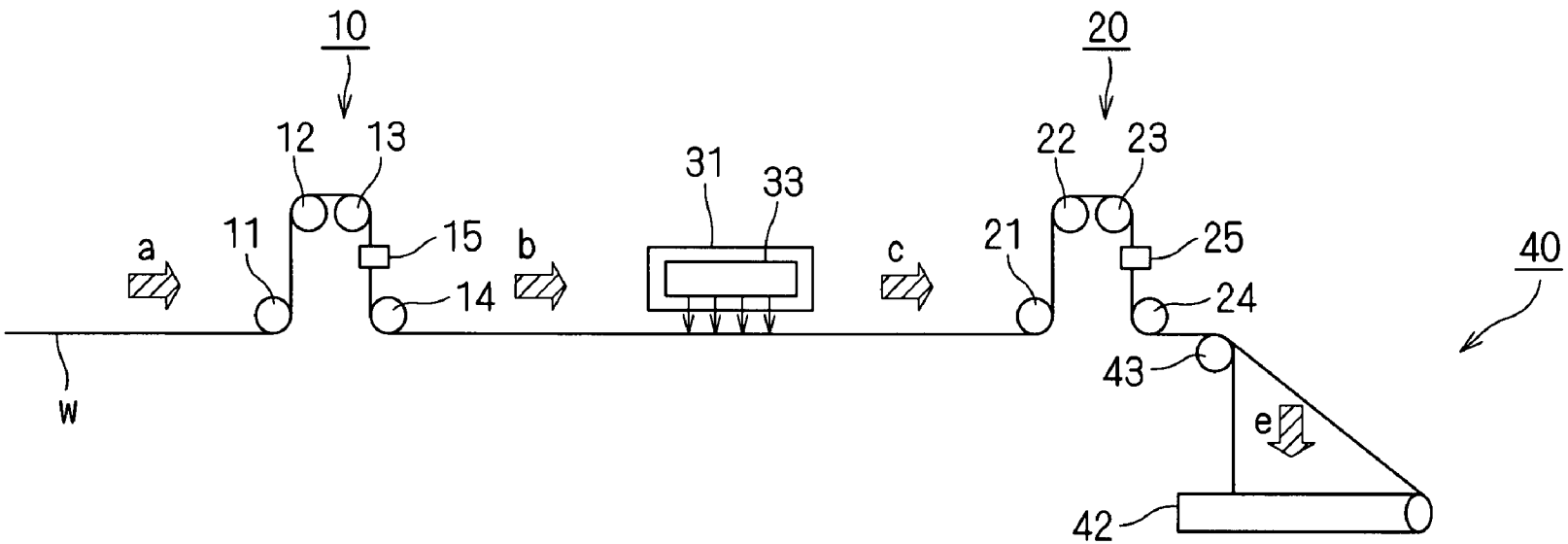
FIGS. 2 and 3 are partial side views of the ink jet printer according to the first preferred embodiment of the present invention.
Figure 3:
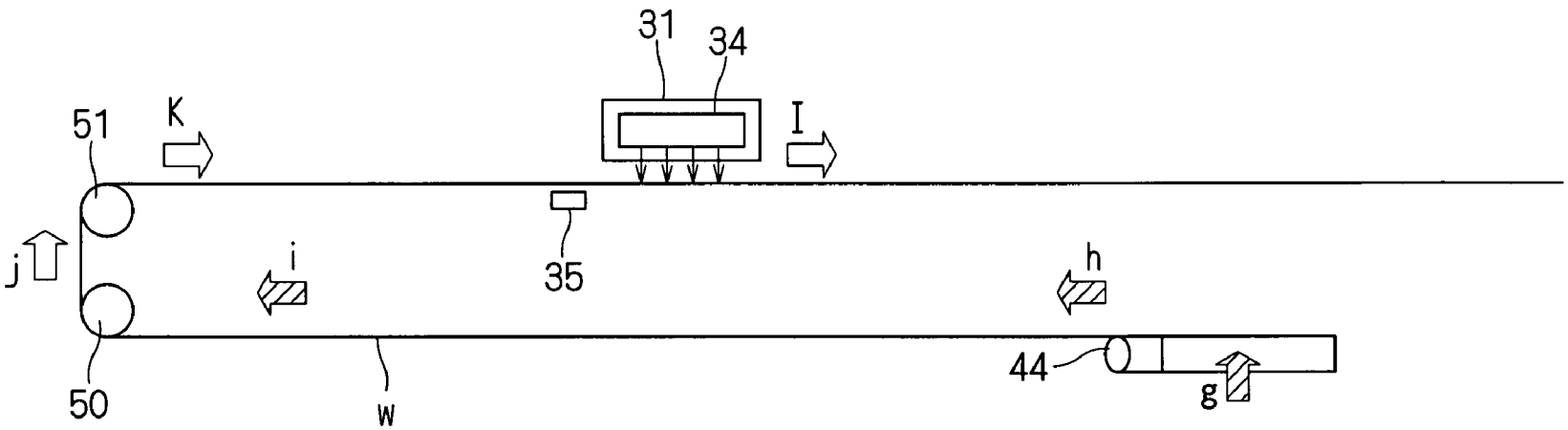

An ink jet printer according to a first preferred embodiment of the present invention will be described with reference to FIGS. 1 to 3. FIG. 1 is a top view of the ink jet printer. This ink jet printer includes two printing units (a first-side printing unit 33 and a second-side printing unit 34) coupled to a common position adjustment mechanism. For duplex printing, the ink jet printer uses one (first-side printing unit 33) of the two printing units for printing on one side of a web and uses the other one (second-side printing unit 34) for printing on the other side of the web. FIG. 2 is a side view taken along the dashed dotted line x1-x1 of FIG. 1, showing a portion of the ink jet printer above the line x1-x1; and FIG. 3 is a side view taken along the dashed dotted line x2-x2 of FIG. 1, showing a portion of the ink jet printer below the dashed dotted line x1-x1. This ink jet printer is a printer for printing on both sides of a long length of web or printing medium (to be printed) while transporting the web along the web length.

The ink jet printer according to the first preferred embodiment of the present invention primarily includes a first edge guide 10, a second edge guide 20, a printing unit 30, a direction changing unit 40, and rollers 50 and 51. When referring to an angle in a horizontal plane in the following description, a clockwise direction in FIG. 1 is defined as positive.

The first edge guide 10 includes a roller 11 which causes a web w traveling horizontally in a direction of the arrow a to be oriented upward; a roller 12 which causes the web W to be oriented horizontally again; a roller 13 which causes the web W traveling horizontally between the rollers 12 and 13 to be oriented downward; and a roller 14 which causes the web w to be oriented horizontally again (cf. arrow b). The first edge guide 10 further includes a first edge sensor 15 and a first edge-guide actuator 16. The rollers 12 and 13 are held by a frame body (not shown) that is rotatable upon a center of rotation C1 (a central point of the roller 12 in a horizontal plane). The first edge-guide actuator 16 is coupled to this frame body and is capable of rotating the frame body upon the center of rotation C1 to shift the web W parallel in a direction orthogonal to the direction of travel of the web w. More specifically, the first edge-guide actuator 16 is a driving force for edge guiding, which changes the direction of the web W traveling from the roller 12 to the roller 13, thereby to change the edge position (position in the direction of web width perpendicular to the direction of travel) of the web w outputted from the first edge guide 10, from its original position at the input of the first edge guide 10. The first edge sensor 15 is provided between the rollers 13 and 14 to detect the edge position of the web w between the rollers 13 and 14.

Figure 4:
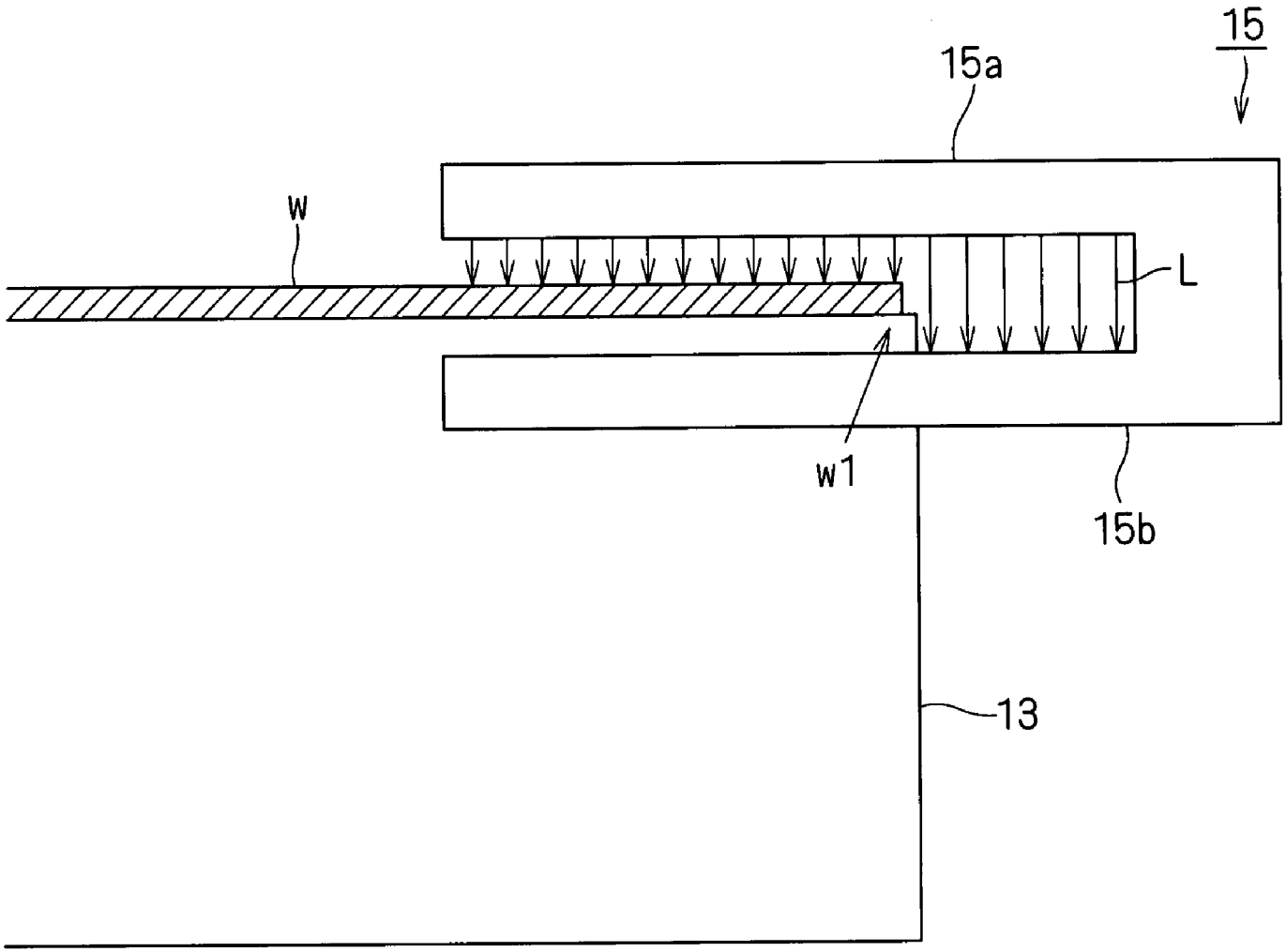
FIG. 4 is a top view showing, in an enlarged scale, the vicinity of a first edge sensor in the ink jet printer according to the first preferred embodiment of the present invention.

FIG. 4 is an enlarged top view of the roller 13 and the first edge sensor 15. The first edge sensor 15 is mounted on a case of the ink jet printer. Thus, the first edge sensor 15 does not move with movement of the frame body of the first edge guide 10. As shown in FIG. 4, the first edge sensor 15 includes a sensor unit 15*a*, and another sensor unit 15*b* spaced as opposed to the sensor unit 15*a* with a predetermined interval. The first edge sensor 15 allows one edge w1 of the web w to pass through between the sensor units 15*a* and 15*b*. The sensor unit 15*a* emits a plurality of sensing lights L from its light emitters (not shown) to light receivers (not shown) of the sensor unit 15*b*. The amount of light detected by the light receivers varies depending on the amount that the web W cuts off the sensing lights L. Based on the variable amount of light detected by the light receivers, the first edge sensor 15 detects the position of the edge w1 of the web w.

Referring back to FIGS. 1 to 3, the second edge guide 20 includes a roller 21 which causes the web w traveling horizontally (cf. arrow c) to be oriented upward; a roller 22 which causes the web w to be oriented horizontally again; a roller 23 which causes the web w traveling horizontally between the rollers 22 and 23 to be oriented downward; and a roller 24 which causes the web w to be oriented horizontally again (cf. arrow d). The second edge guide 20 further includes a second edge sensor 25 and a second edge-guide actuator 26. The rollers 22 and 23 are held by a frame body (not shown) that is rotatable upon a center of rotation C2 (a central point of the roller 22 in a horizontal plane). The second edge-guide actuator 26 is coupled to this frame body and rotates the frame body upon the center of rotation C2 so that the web w outputted from the second edge guide 20 can be shifted parallel in a direction orthogonal to the direction of travel of the web w, from its original position at the input of the second edge guide 20. That is, the second edge-guide actuator 26 is a driving force for edge guiding, which changes the direction of the web w traveling from the roller 22 to the roller 23, thereby to change the edge position (position in the direction of web width perpendicular to the direction of travel) of the web w outputted from the second edge guide 20, from its original position at the input of the second edge guide 20. The second edge sensor 25 is provided between the rollers 23 and 24 to detect the edge position of the web w between the rollers 23 and 24. The second edge sensor 25 is identical in structure to the first edge sensor 15 described with reference to FIG. 4, and thus will not be described here in detail.

The direction changing unit 40 includes a turning bar 42, a roller 43, and a turning bar 44. The turning bar 42 is inclined 45 degrees with respect to the direction of travel of the web w (cf. arrow d) on the upstream side of the direction changing unit 40, and is located at a lower level than the position of the web w traveling upstream of the direction changing unit 40. The roller 43 is located at a right angle to the direction of travel of the web w (cf. arrow d) on the upstream side of the direction changing unit 40, and is located at the same level as the position of the web w traveling upstream of the direction changing unit 40. The turning bar 44 is inclined 135 degrees with respect to the direction of travel of the web w (cf. arrow d) on the upstream side of the direction changing unit 40. The turning bar 44 is located at the same level as the turning bar 42.

The web w is oriented downward by the roller 43 and loops around the turning bar 42, thereby to be rotated 90 degrees and flipped over in a horizontal plane.

After passing through the turning bar 42, the web w further loops around the turning bar 44 to be further rotated 90 degrees and flipped over again in a horizontal plane. In this way, the direction changing unit 40 shifts the path of travel of the web w parallel in the direction of the web width as well as rotates the direction of travel 180 degrees, and further shifts the position of travel to a lower level.

The rollers 50 and 51 have the functions of flipping over a horizontally traveling web w (cf. arrow i) as well as shifting the path of travel of the web w to an upper level and further reversing the direction of travel. After passing through the roller 51, the surface of the web w which is opposite to the surface facing the first-side printing unit 33 is oriented upward and faces the second-side printing unit 34.

The web w, after passing through the second-side printing unit 34, is further transported downstream and wound up into a winding mechanism after going through a drier where the web w is dried or the like.

In the following description, we refer to the path from the roller 14 of the first edge guide 10 to the roller 21 of the second edge guide 20 as a first transport path P1 (indicated by the arrows a, b, and c), the path from the roller 21 to the turning bar 44 as a second transport path P2 (indicated by the arrows d, e, f, and g), the path from the turning bar 44 to the roller 50 as a third transport path P3 (indicated by the arrows h and i), and the path downstream of the roller 51 as a fourth transport path P4 (indicated by the arrows k and l).

The ink jet printer according to this preferred embodiment prints on both sides of a relatively narrow web w by transporting the web w along the first to fourth transport paths P1 to P4 sequentially in this order. However, the ink jet printer can also print on one side (the upper surface) of a relatively wide web by transporting the web simultaneously along the first and fourth transport paths P1 and P4.

The printing unit 30 includes a printing unit body 31 and ink jet bars 32 (32*c*, 32*m*, 32*y*, and 32*k*) each including a plurality of ink jet nozzles. These ink jet bars 32*c*, 32*m*, 32*y*, and 32*k* are fixed to the printing unit body 31. The ink jet bars 32*c*, 32*m*, 32*y*, and 32*k* are located above the web w and directs a jet of ink at the web w traveling thereunder according to image signals. The plurality of ink jet nozzles provided with each of the ink jet bars 32*c*, 32*m*, 32*y*, and 32*k* are divided for use into the first-side printing unit 33 for printing on one side of the web w traveling in the direction indicated by the arrows b and c, and the second-side printing unit 34 for printing on the other side of the web w traveling in the direction indicated by the arrows k and l.

The printing unit 30 further includes a head edge sensor 35 which is fixed to the case of the ink jet printer, for detecting the edge position of the web w located at a position facing the second-side printing unit 34; and a head shift actuator 36 for shifting the entire printing unit body 31 in the direction of the width of the web w, according to the edge position of the web w detected by the head edge sensor 35.

In the printer according to this preferred embodiment, even if the direction of travel of the web w along the fourth transport path P4 is slightly displaced in the direction of the width of the web w (i.e., direction orthogonal to the direction of travel of the web w), such displacement can be comprehensively corrected.

More specifically, the amount of displacement in the direction of the width of the web w between the second-side printing unit 34 and the web w is detected on the fourth transport path P4, and the printing unit body 31 is shifted according to the amount of displacement. The above shifting of the printing unit body 31 causes a displacement between the first-side printing unit 33 and the web w on the first transport path P1, which is corrected through the operation of the first edge guide 10.

Figure 5:
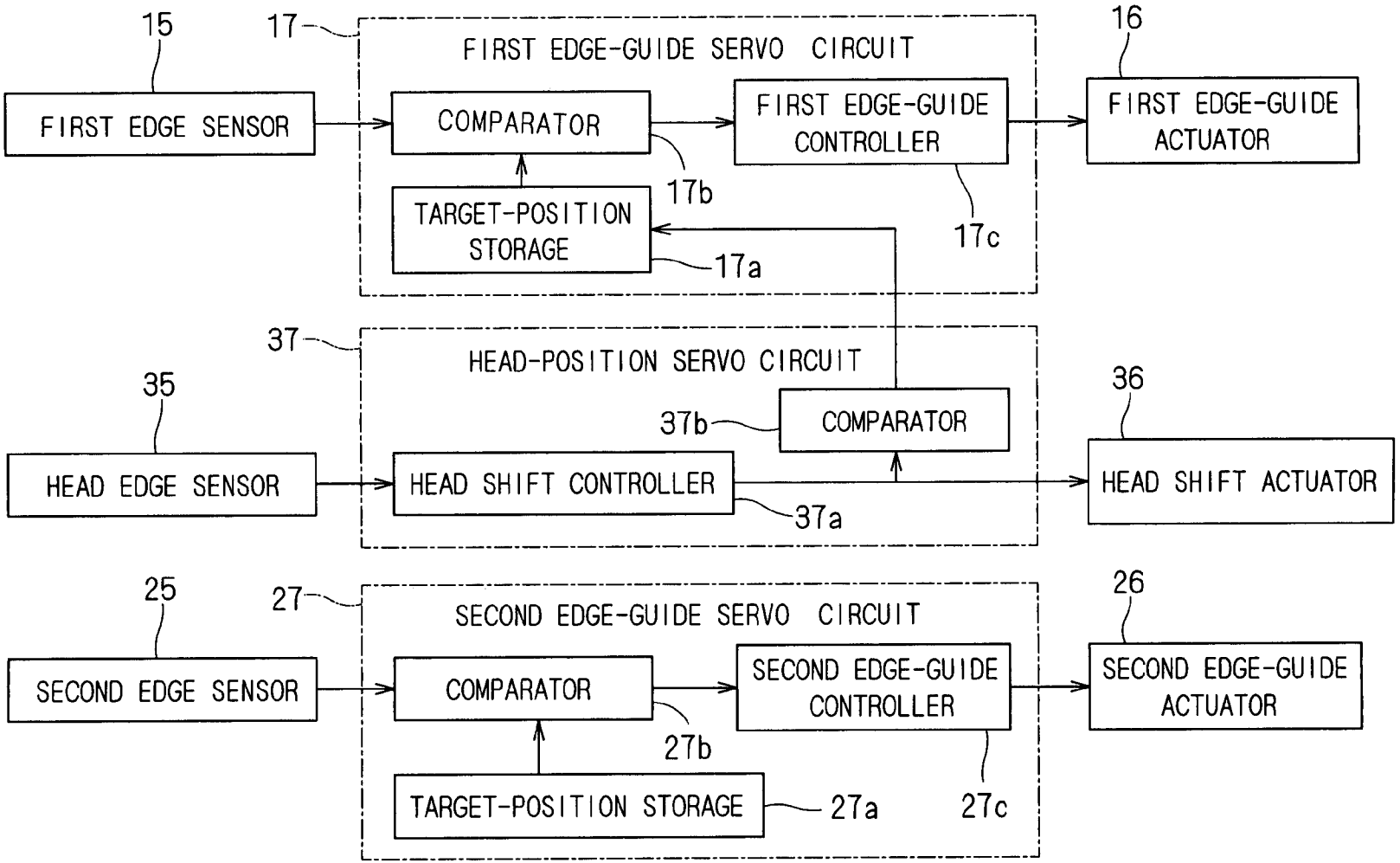
FIG. 5 is a control block diagram of the ink jet printer according to the first preferred embodiment of the present invention.

FIG. 5 is a control block diagram of the ink jet printer.

As shown in FIG. 5, a control system in the ink jet printer according to this preferred embodiment consists of three servo circuits (a first edge-guide servo circuit 17, a second edge-guide servo circuit 27, and a head-position servo circuit 37). The first edge-guide servo circuit 17 operates in association with a signal outputted from the head-position servo circuit 37.

The first edge-guide servo circuit 17 includes a target-position storage 17*a* for storing a target position given from the head-position servo circuit 37; a comparator 17*b* for making a comparison between the edge position of the web w detected by the first edge sensor 15 and the target position outputted from the target-position storage 17*a* to output an error signal that represents the direction and amount of displacement therebetween; and a first edge-guide controller 17*c* for outputting to the first edge-guide actuator 16, a drive signal that causes the rollers 12 and 13 of the first edge guide 10 to move in a direction of correcting the above displacement according to the error signal.

The second edge-guide servo circuit 27 includes a target-position storage 27*a* for storing a target edge position of the web w; a comparator 27*b* for making a comparison between the edge position of the web w detected by the second edge sensor 25 and the target edge position outputted from the target-position storage 27*a* to output an error signal that represents the direction and amount of displacement therebetween; and a second edge-guide controller 27*c* for outputting to the second edge-guide actuator 26, a drive signal that causes the rollers 22 and 23 of the second edge guide 20 to move in a direction of correcting the above displacement according to the error signal.

The head-position servo circuit 37 includes a head shift controller 37*a* for outputting a drive signal to the head shift actuator 36 according to a signal from the head edge sensor 35 which detects the amount of zigzag movement of the web w located at a position facing the second-side printing unit 34 of the printing unit 30, the drive signal causing the printing unit body 31 to shift in the direction of the web width in accordance with the above amount of zigzag movement. The head-position servo circuit 37 further includes a converter 37*b* for outputting a target position of the web w on the first transport path P1 to the target-position storage 17*a* according to the position of the printing unit body 31.

The first edge-guide servo circuit 17 performs feedback control to match the edge position of the web w detected by the first edge sensor 15 with the target position stored in the target-position storage 17*a*. That is, the comparator 17*b* makes a comparison between the edge position of the web w detected by the first edge sensor 15 and the target position, and the first edge-guide controller 17*c* outputs such a drive signal as to reduce this difference to zero, to the first edge-guide actuator 16.

The second edge-guide servo circuit 27 performs feedback control to match the edge position of the web w detected by the second edge sensor 25 with the target position stored in the target-position storage 27*a*. That is, the comparator 27*b* makes a comparison between the edge position of the web w detected by the second edge sensor 25 and the target edge position, and the second edge-guide controller 27*c* outputs such a drive signal as to reduce this difference to zero, to the second edge-guide actuator 26. Since the target edge position stored in the target-position storage 27*a* of the second edge-guide servo circuit 27 will not be rewritten, the edge position of the web w downstream of the second edge guide 20 is controlled to be kept at a fixed position.

On the other hand, the target position stored in the target-position storage 17*a* of the first edge-guide servo circuit 17 is rewritten according to the target position given from the head-position servo circuit 37. Thus, the edge position of the web w downstream of the first edge guide 10 is controlled as appropriate.

Figure 6:
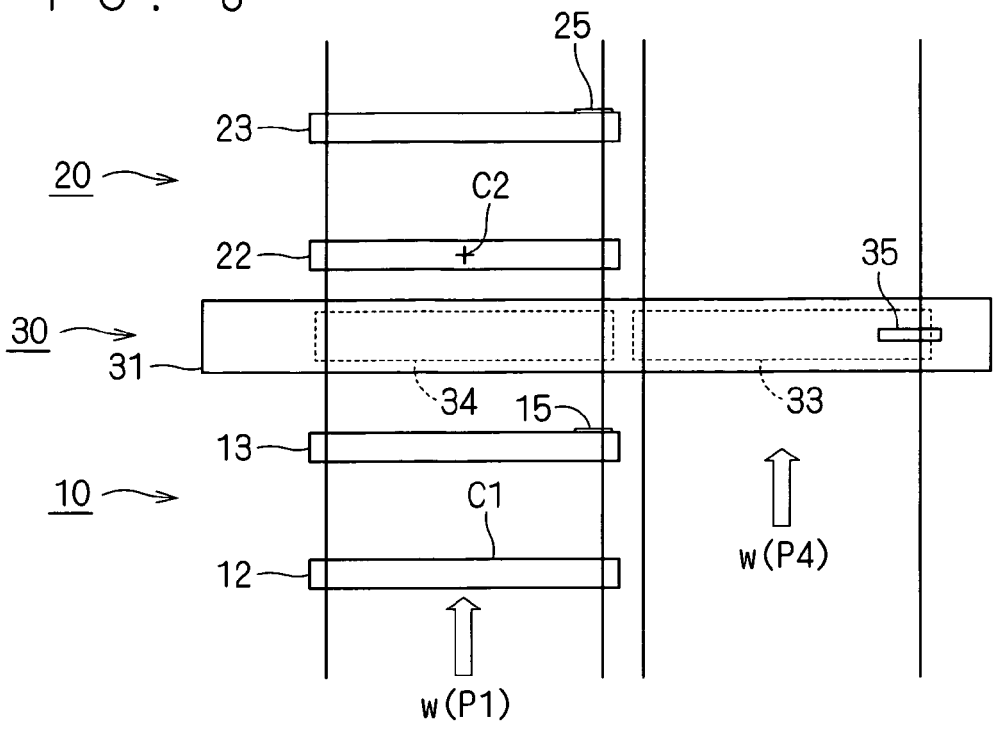
FIGS. 6 and 7 are explanatory diagrams for explaining correction of zigzag movement by the ink jet printer according to the first preferred embodiment of the present invention.
Figure 7:
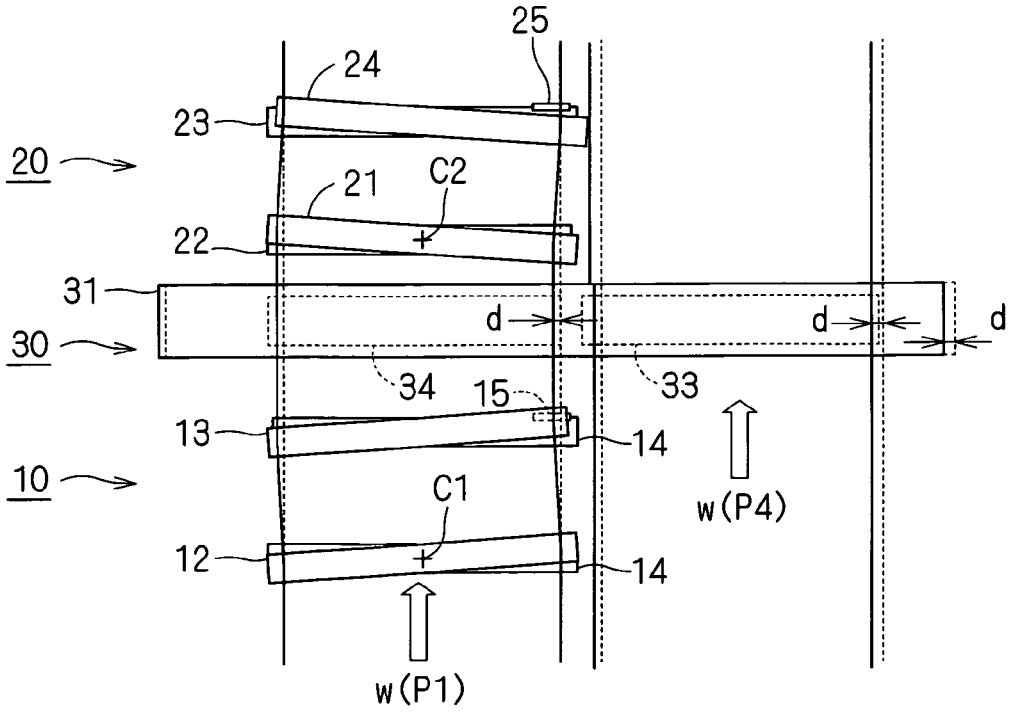

FIGS. 6 and 7 are schematic diagrams for explaining the interrelationship of the first edge guide 10, the second edge guide 20, and the printing unit 30. FIG. 6 shows the case of no zigzag movement of the web w on the first and fourth transport paths P1 and P4.

Suppose that, as shown in FIG. 7, the web w (P4) at a position facing the head edge sensor 35 on the fourth transport path P4 moves a distance d in zigzag in the direction of its width. When the web w (P4) on the fourth transport path P4 starts to move in zigzag, the direction and amount of the zigzag movement of the web w (P4) are detected by the head edge sensor 35. Then, the head-position servo circuit 37 shifts the printing unit body 31 according to the direction and amount of the zigzag movement of the web w in such a manner that the relative positions of the second-side printing unit 34 and the web w with respect to the direction of the web width are kept in the state of FIG. 6. That is, the printing unit body 31 is shifted by the distance d in the direction orthogonal to the direction of web travel.

Further, the first edge-guide servo circuit 17 rotates the rollers 12 and 13 upon the center of rotation C1 according to the above shifting of the printing unit body 31, thereby to shift the web w (P1) on the first transport path P1 parallel in the direction orthogonal to the direction of web travel in such a manner that the relative positions of the web w (P1) and the printing unit body 31 on the first transport path P1 are maintained. This also causes the web w (P1) to shift the distance d parallel in the direction orthogonal to the direction of web travel.

On the other hand, the second edge-guide servo circuit 27 rotates the rollers 22 and 23 upon the center of rotation C2 to shift the web w in parallel in such a manner that the edge position of the web w facing the second edge sensor 25 is kept at a fixed position.

Figure 8:
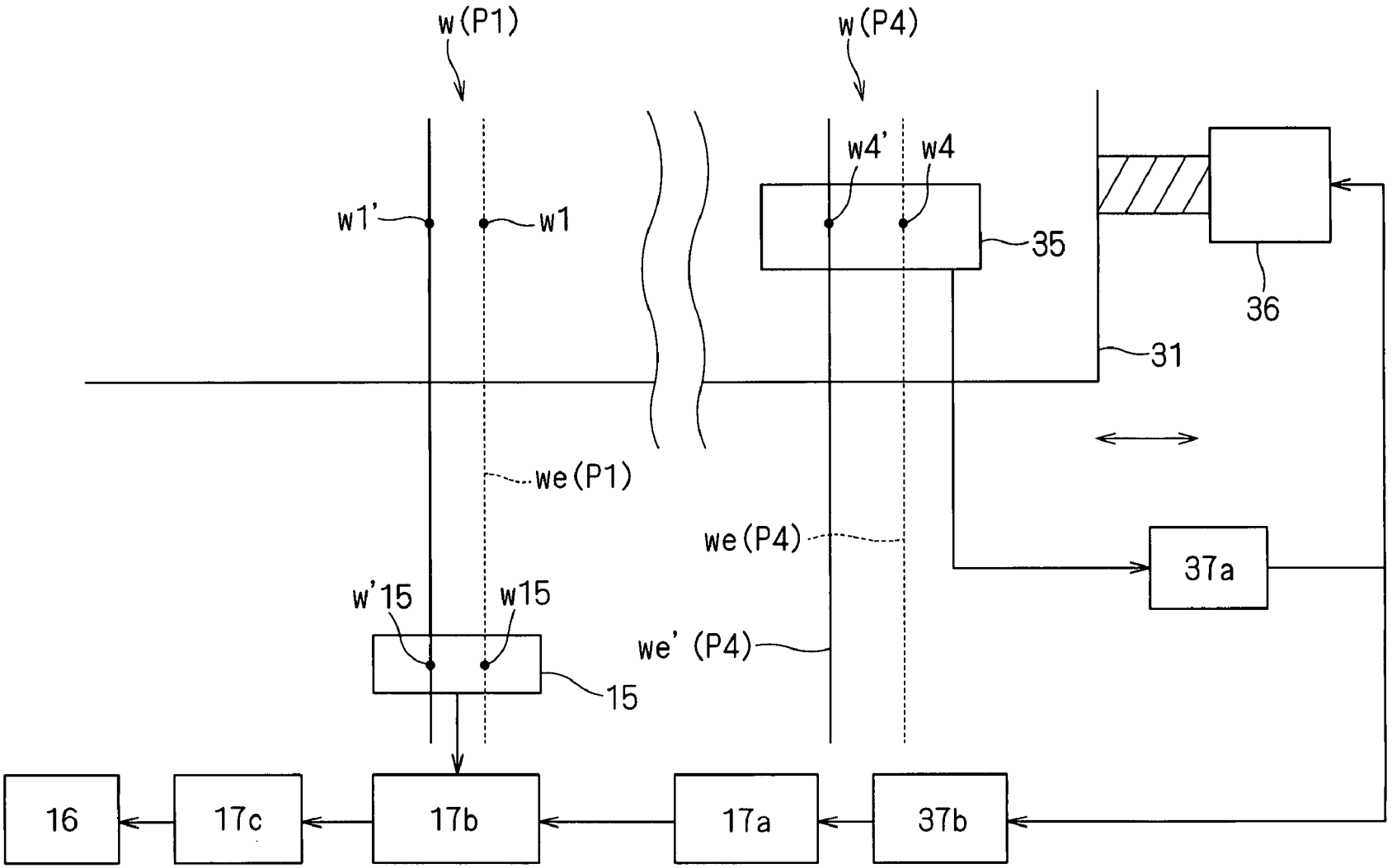
FIG. 8 is a control block diagram of the ink jet printer according to the first preferred embodiment of the present invention.

FIG. 8 is an explanatory diagram for explaining correction of zigzag movement in the ink jet printer. This ink jet printer exercises control to keep always constant the relative positions of the edge (w4) of the web w on the fourth transport path P4 detected by the head edge sensor 35, the edge (w1) of the web w on the first transport path P1 corresponding to the edge w4, and the printing unit body 31. An intersection of a straight line extending from the edge position w4 on the fourth transport path P4 in the direction of extension of the ink jet bars 32 and the edge of the web w on the first transport path P1 is referred to as the edge position w1 on the first transport path P1 corresponding to the edge position w4.

In FIG. 8, if the edge of the web w (P4) on the fourth transport path P4 moves from a position we (P4) shown by the dotted line to a position we' (P4) shown by the solid line, the edge position w4 detected by the head edge sensor 35 changes to w4'. According to the change in the edge position of the web w detected by the head edge sensor 35, the head shift controller 37*a* generates and supplies a drive signal which causes shifting of the printing unit body 31, to the head shift actuator 36.

The above drive signal is also supplied to the converter 37*b*. The converter 37*b* determines a target position w1' of the edge position w1 corresponding to the shifted printing unit body 31 by analysis of the drive signal, and sets this target position w1' to the target-position storage 17*a* as a target position to be detected by the first edge sensor 15.

The comparator 17*b* of the first edge-guide servo circuit 17 makes a comparison between a newly set target position in the target-position storage 17*a* and the edge position outputted from the first edge sensor 15 to generate and supply an error signal to the first edge-guide controller 17*c*. The first edge-guide controller 17*c* outputs such a drive signal as to reduce the error signal to zero, to the first edge-guide actuator 16. This causes the frame body, which holds the rollers 12 and 13, to rotate in accordance with the shifting of the printing unit body 31 and thereby causes the web w (P1) on the first transport unit P1 to shift parallel in the direction of its width.

The above rotation of the frame body of the first edge guide 10 also causes a change in the input position of the web w at the second edge guide 20. However, this change in position will be resolved by the feedback function of the second edge-guide servo circuit 27. Thus, the edge position of the web w downstream of the second edge guide 20 will be kept at a fixed position.

Now, a second preferred embodiment of the present invention will be described with reference to FIGS. 9 and 10. The second preferred embodiment is different from the first preferred embodiment described with reference to FIGS. 6 to 8, in that a head edge sensor 135 located on the fourth transport path P4 detects not the edge of the web w, but marks m which are previously printed on one side of the web w (i.e., web surface facing the first-side printing unit 33). The head edge sensor 135 is thus located on the opposite side of the second-side printing unit 34 so that the web w is positioned between the head edge sensor 135 and the second-side printing unit 34.

The marks m are reference marks for use in registration between images printed on one and the other sides of the web w, and are printed for example by the first-side printing unit 33.

Figure 9:
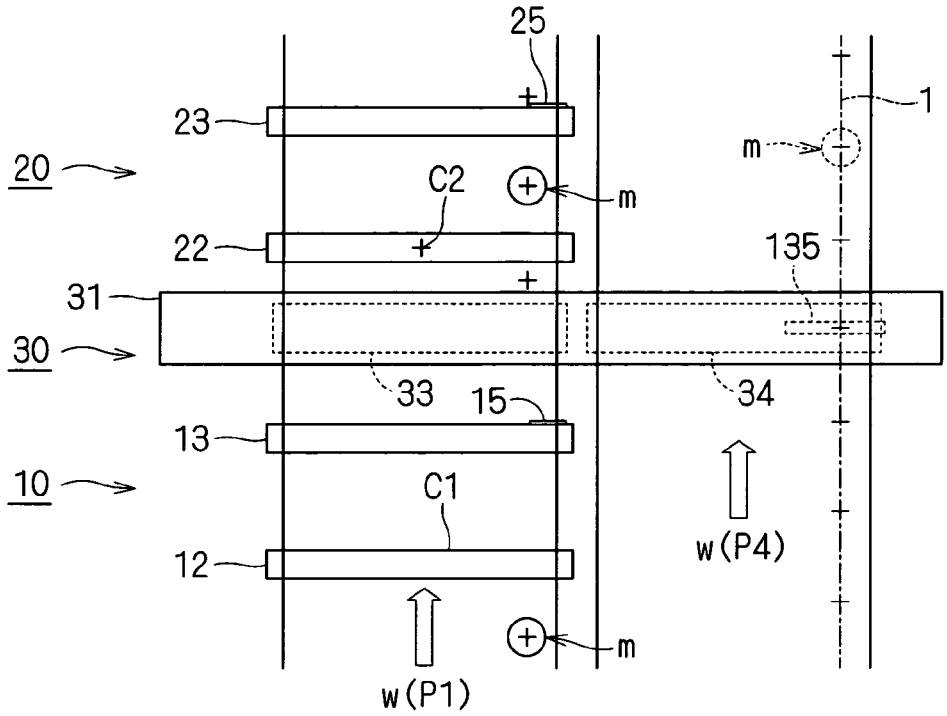
FIGS. 9 and 10 are explanatory diagrams for explaining registration according to a second preferred embodiment of the present invention.

FIG. 9 shows the case where the marks m on the web w and the second-side printing unit 34 are in proper alignment on the fourth transport path P4.

Figure 10:
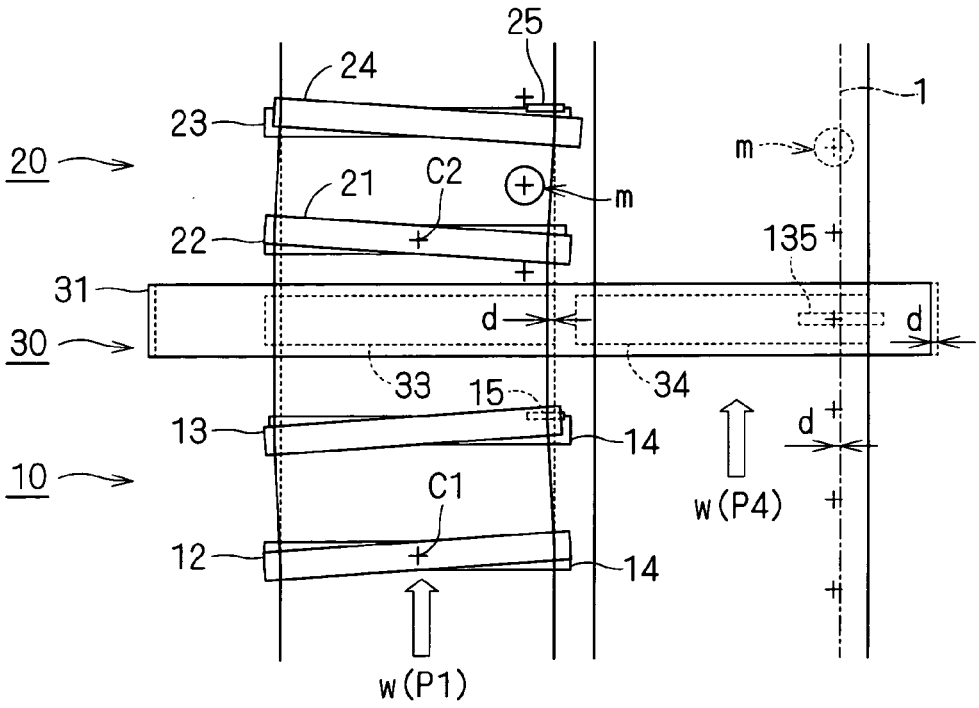

Suppose that the marks m and the head edge sensor 135 are misaligned by any cause as shown in FIG. 10. The dashed dotted line l in FIG. 10 shows an intended position of the marks m. In the present example, the marks m printed on the web w are displaced by a distance d from their intended position l in the direction of the web width.

This will cause a displacement between images printed on the front and back sides of the web w. Thus, the head shift controller 37*a* shifts the printing unit body 31 by the distance d in the direction of the web width, according to the above direction and amount of displacement detected by the head edge sensor 135.

Simultaneously, as in the first preferred embodiment, the first edge guide 10 shifts the web w (P1) on the first transport path P1 in the direction of the web width. Thereby, the relative positions of the first-side printing unit 33 and the web w are kept as they were before the shifting of the printing unit body 31.

Figure 11:
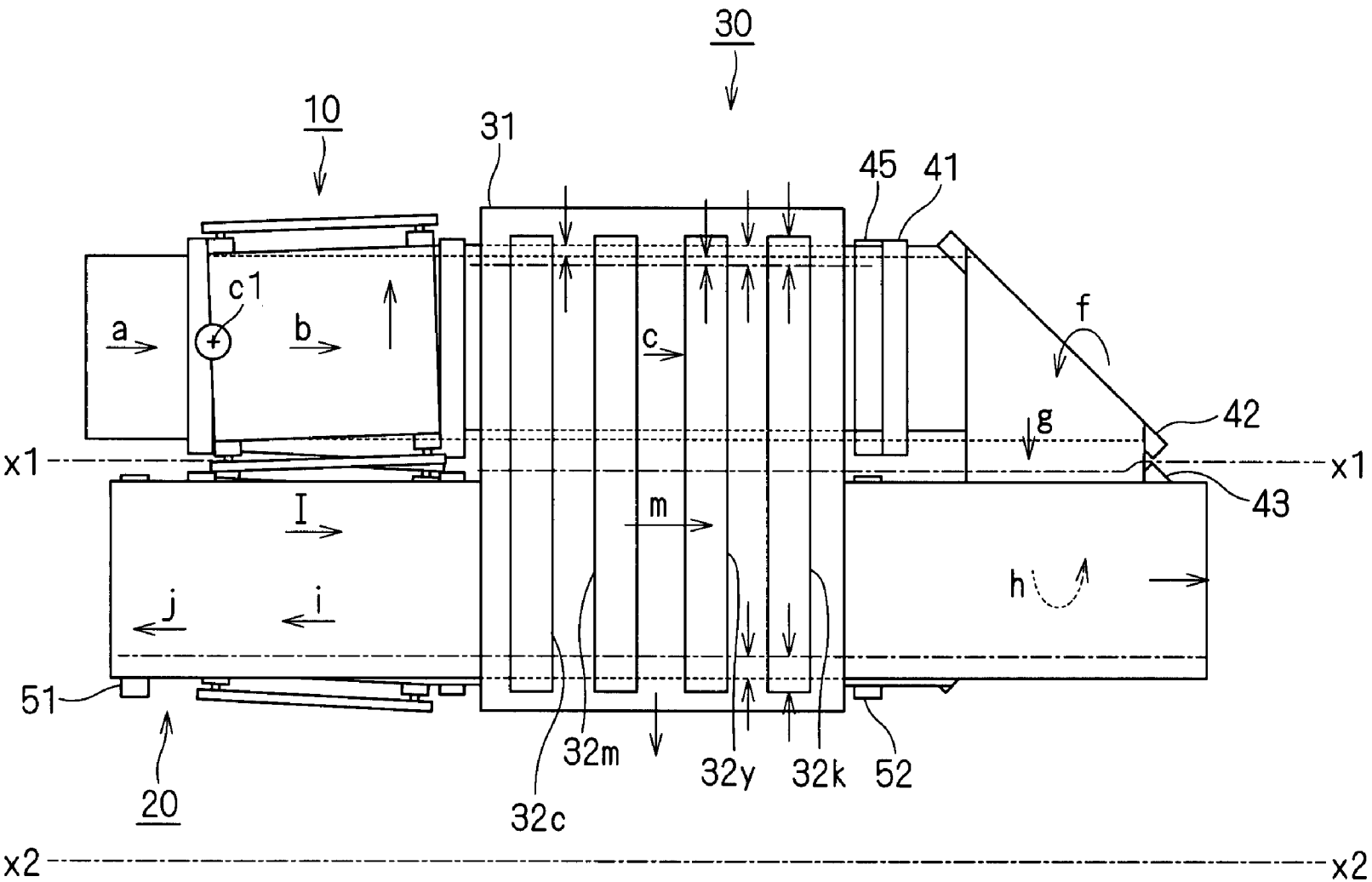
FIG. 11 is a top view of an ink jet printer according to a third preferred embodiment of the present invention.
Figure 12:
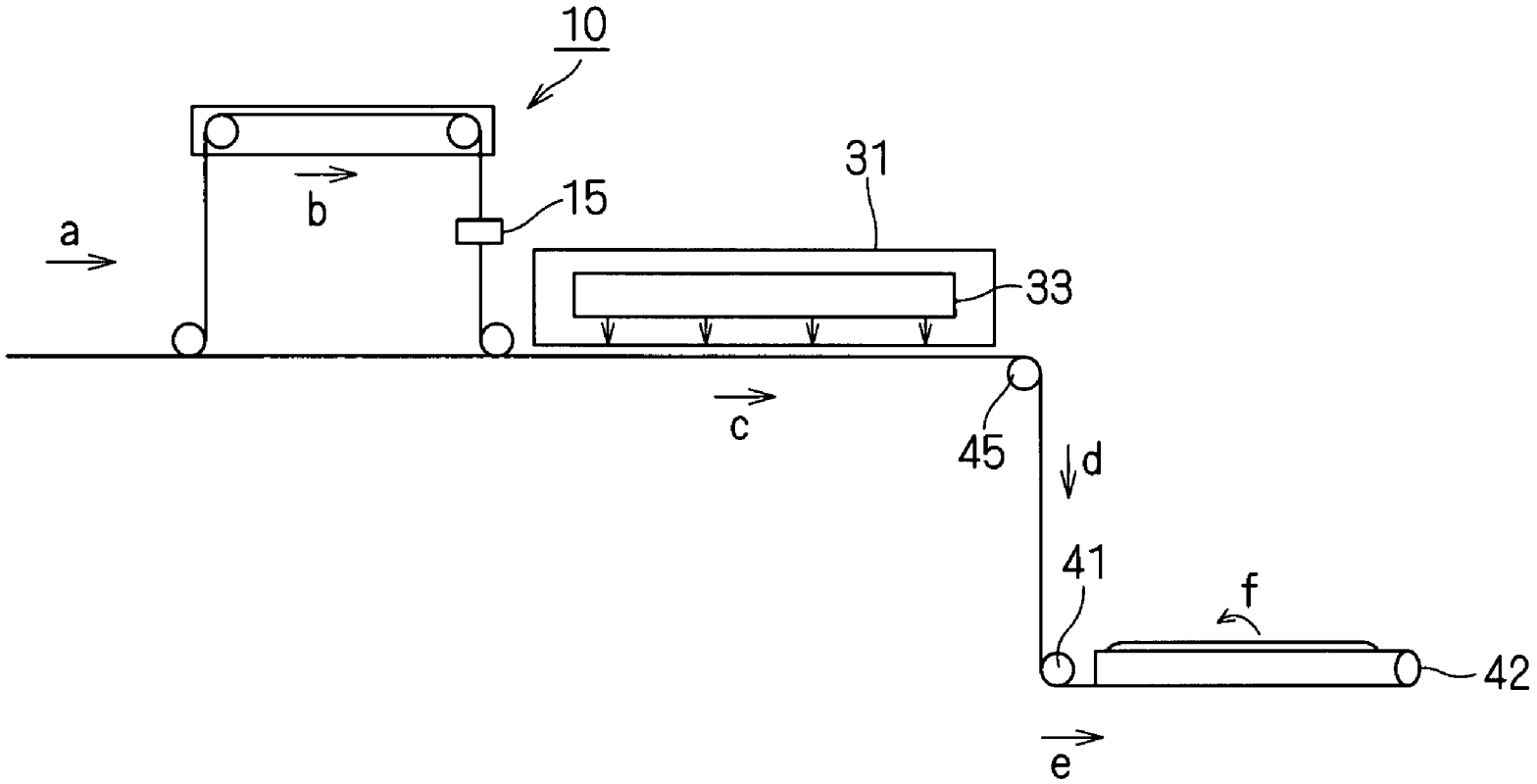
FIGS. 12 and 13 are partial side views of the ink jet printer according to the third preferred embodiment of the present invention.
Figure 13:
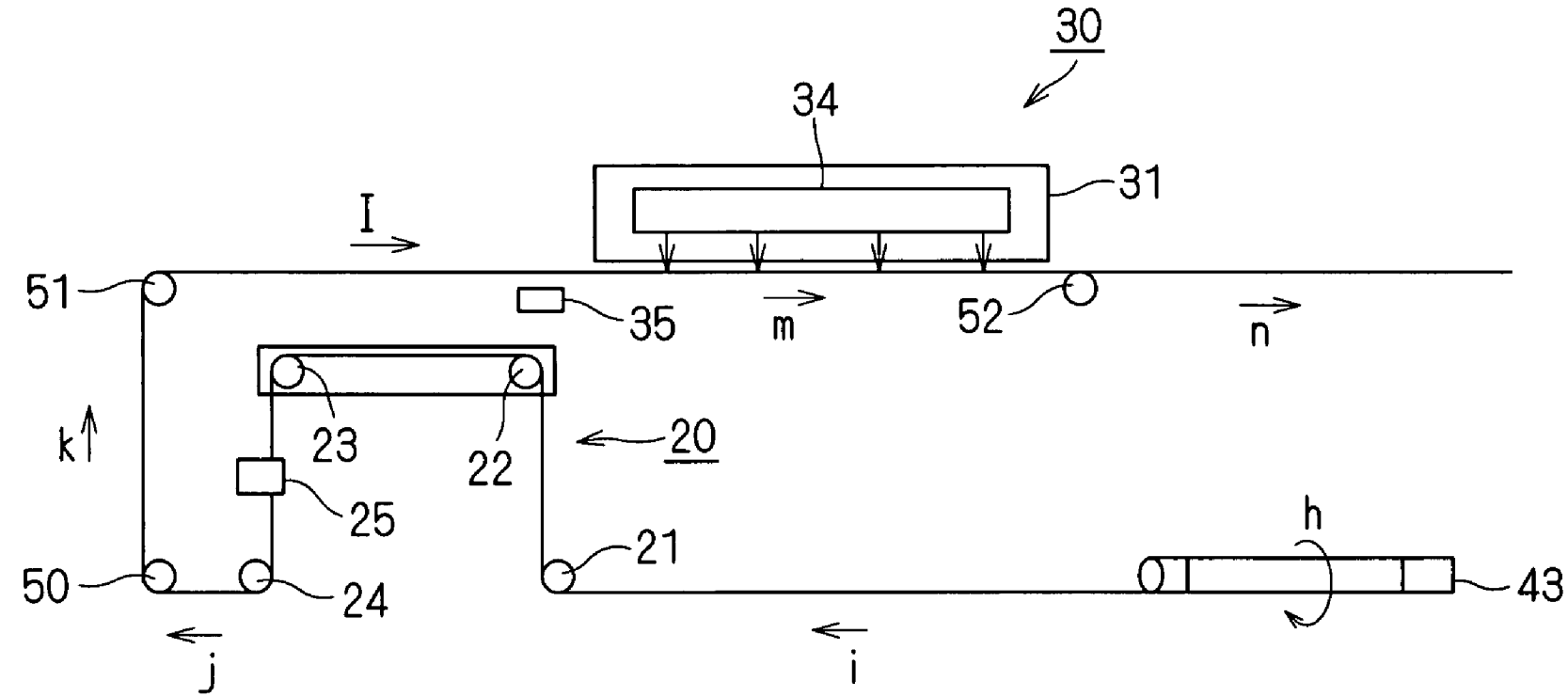

Now, a third preferred embodiment of the present invention will be described with reference to FIGS. 11 to 13. FIG. 11 is a top view of an ink jet printer according to the third preferred embodiment. FIG. 12 is a side view taken along the dashed dotted line x1-x1 of FIG. 11, showing a portion of the ink jet printer above the line x1-x1; and FIG. 13 is a side view taken along the dashed dotted line x2-x2 of FIG. 11, showing a portion of the ink jet printer below the dashed dotted line x1-x1.

The ink jet printer according to the third preferred embodiment includes the first edge guide 10, the printing unit 30, the roller 41, a roller 45, the turning bars 42 and 43, the second edge guide 20, and the rollers 50 and 51.

After the first edge guide 10 determines the position of the web w along the direction of the web width, the web w is transmitted to the printing unit 30.

After the web w has passed under the first-side printing unit 33, the roller 45 changes the direction of travel of the web w to a downward direction (cf. arrow d). Then, the web w is oriented horizontally by the roller 41 (cf. arrow e).

The web w loops around the turning bar 42 from below, so that the direction of travel is changed 90 degrees and the web w is flipped over (cf. arrow f).

Then, the web w loops around the turning bar 43 from above, so that the direction of travel is further changed 90 degrees and the web w is flipped over (cf. arrow h).

After traveling horizontally in the direction of the arrow i, the web w goes to the second edge guide 20. The second edge guide 20 adjusts the position of the web w along the direction of the web width. After that, the web w passes sequentially through the rollers 50 and 51, so that the direction of travel is changed 180 degrees and the web w is flipped over.

Then, the web w passes under the second-side printing unit 34 of the printing unit 30 and is wound up into a winding mechanism, not shown, on the downstream side.

If the head edge sensor 35 detects a displacement between the second-side printing unit 34 and the web w, the printing unit body 31 is shifted in the direction of the web width. Simultaneously, in order to compensate for a displacement between the first-side printing unit 33 and the web w caused by the shifting of the printing unit body 31, the first edge guide 10 shifts the web w in the horizontal direction by referring to the edge position of the web w outputted from the first edge sensor 15.

The second edge guide 20 performs feedback control by referring to the output of the second edge sensor 25 in such a manner that the edge position of the web w on its downstream side is kept at a fixed position.

While the head edge sensor 35 detects the edges of the web w, it may detect marks printed on one side of the web w described in the second preferred embodiment.

Figure 14:
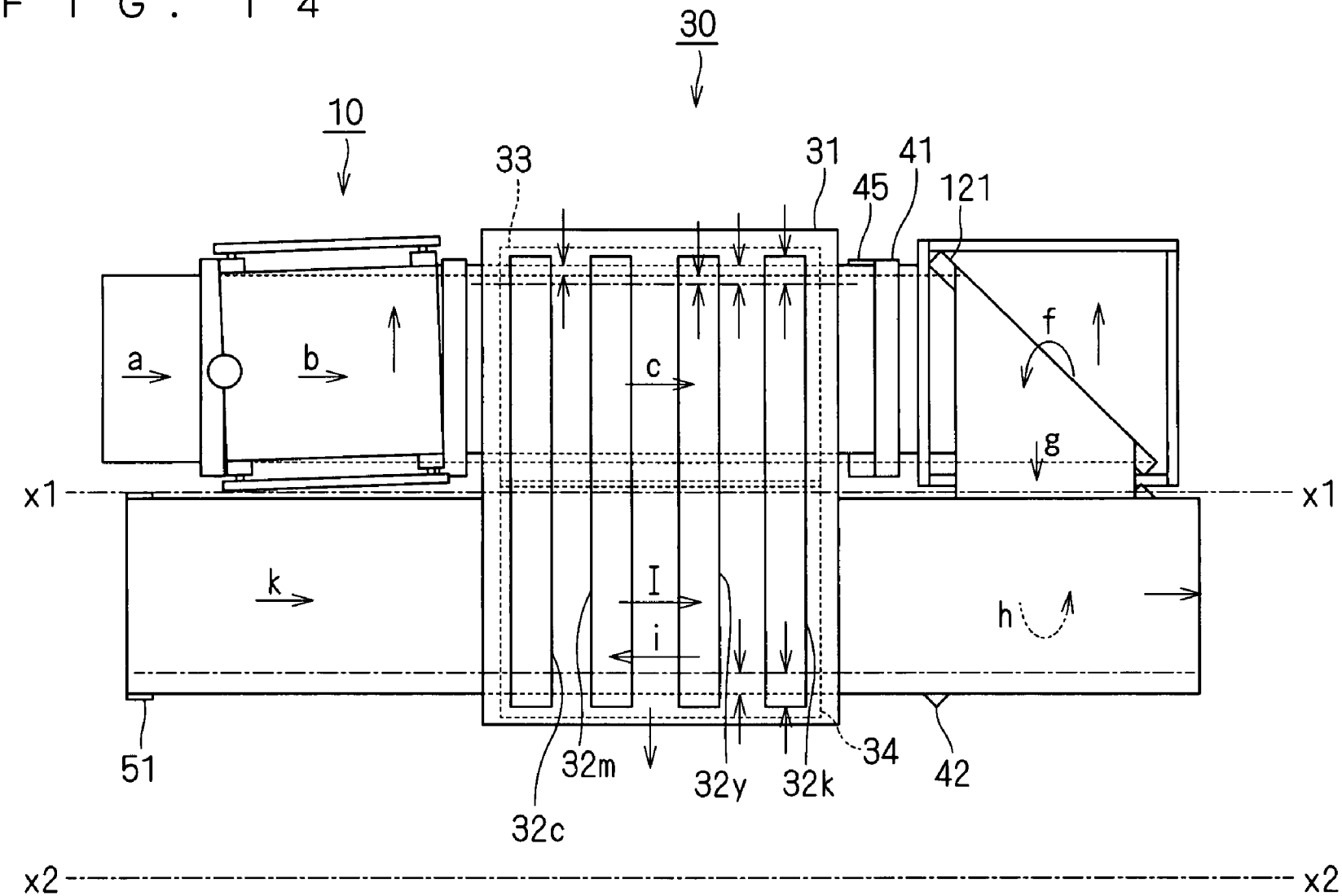
FIG. 14 is a top view of an ink jet printer according to a fourth preferred embodiment of the present invention.
Figure 15:
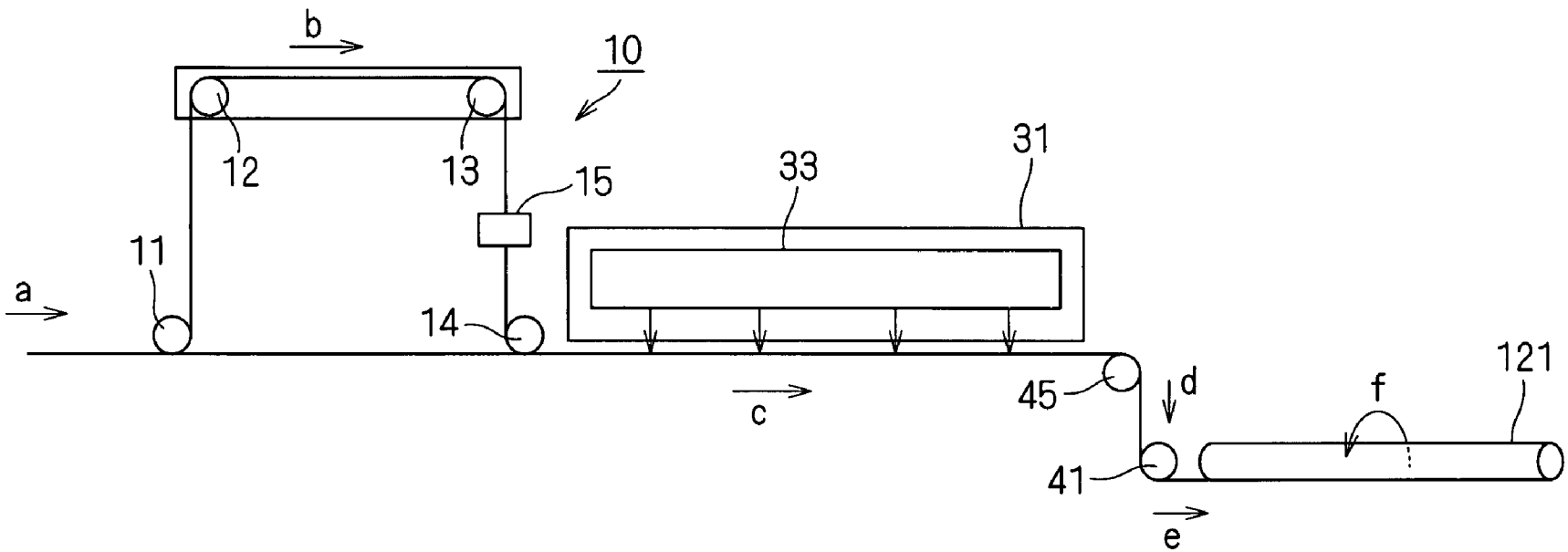
FIGS. 15 and 16 are partial side views of the ink jet printer according to the fourth preferred embodiment of the present invention.
Figure 16:
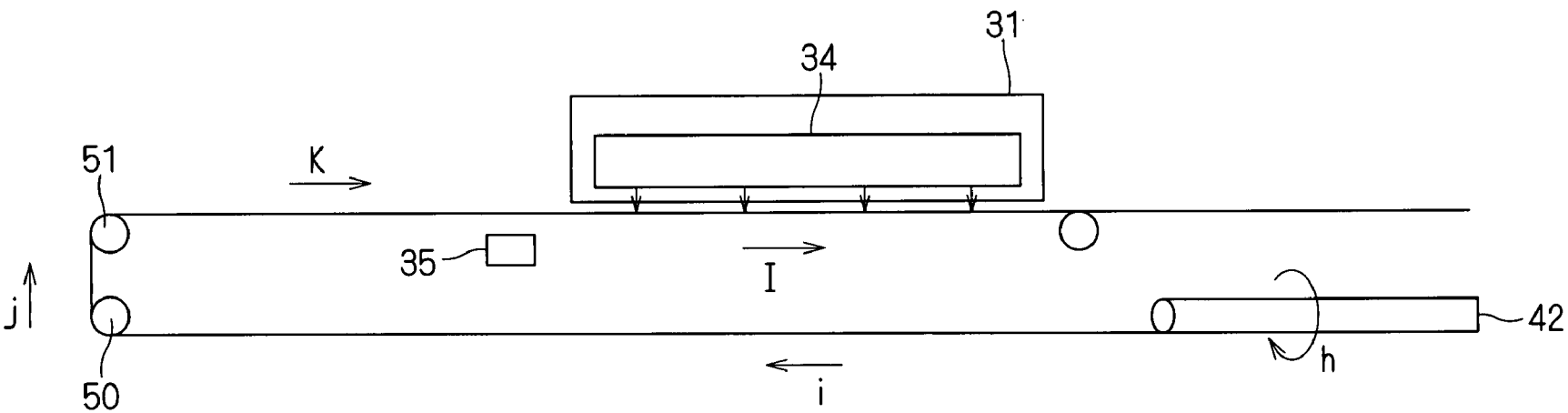

Now, a fourth preferred embodiment of the present invention will be described with reference to FIGS. 14 to 18. FIG. 14 is a top view of an ink jet printer according to the fourth preferred embodiment. FIG. 15 is a side view taken along the dashed dotted line x1-x1 of FIG. 14, showing a portion of the ink jet printer above the line x1-x1; and FIG. 16 is a side view taken along the dashed dotted line x2-x2 of FIG. 14, showing a portion of the ink jet printer below the dashed dotted line x1-x1. The ink jet printer according to the fourth preferred embodiment includes the first edge guide 10, the printing unit 30, the rollers 41 and 45, a turning bar 121, the turning bar 42, and the rollers 50 and 51.

After the first edge guide 10 determines the position of the web w along the direction of the web width, the web w is transmitted to the printing unit 30.

After the web w has passed under the first-side printing unit 33 (cf. arrow c), the roller 45 changes the direction of travel to a downward direction (cf. arrow d). Then, the web w is oriented horizontally by the roller 41 (cf. arrow e).

Then, the web w loops around the turning bar 121 from below, so that the direction of travel is changed 90 degrees and the web w is flipped over (cf. arrow f).

The web w then loops around the turning bar 42 from above, so that the direction of travel is further changed 90 degrees and the web w is flipped over (cf. arrow h).

After traveling horizontally in the direction of the arrow i, the web w goes to the roller 50. The web w passes sequentially through the rollers 50 and 51, so that the direction of travel is changed 180 degrees and the web w is flipped over.

Then, the web w passes under the second-side printing unit 34 of the printing unit 30 (cf. arrow l) and is wound up into a winding mechanism, not shown, on the downstream side.

If the head edge sensor 35 detects a displacement between the second-side printing unit 34 and the web w, the printing unit body 31 is shifted in the direction of the web width. Further, in order to compensate for a displacement between the first-side printing unit 33 and the web w caused by the shifting of the printing unit body 31, the first edge guide 10 shifts the web w in the horizontal direction.

In the ink jet printer according to the fourth preferred embodiment, the turning bar 121 is movable in the direction of the arrow g (the direction of travel of the web w changed by the turning bar 121) and in the opposite direction thereof (−g direction). Moving the turning bar 121 in the g and −g directions allows the edge position of the web w outputted from the turning bar 121 to be kept at a fixed position.

Figure 17:
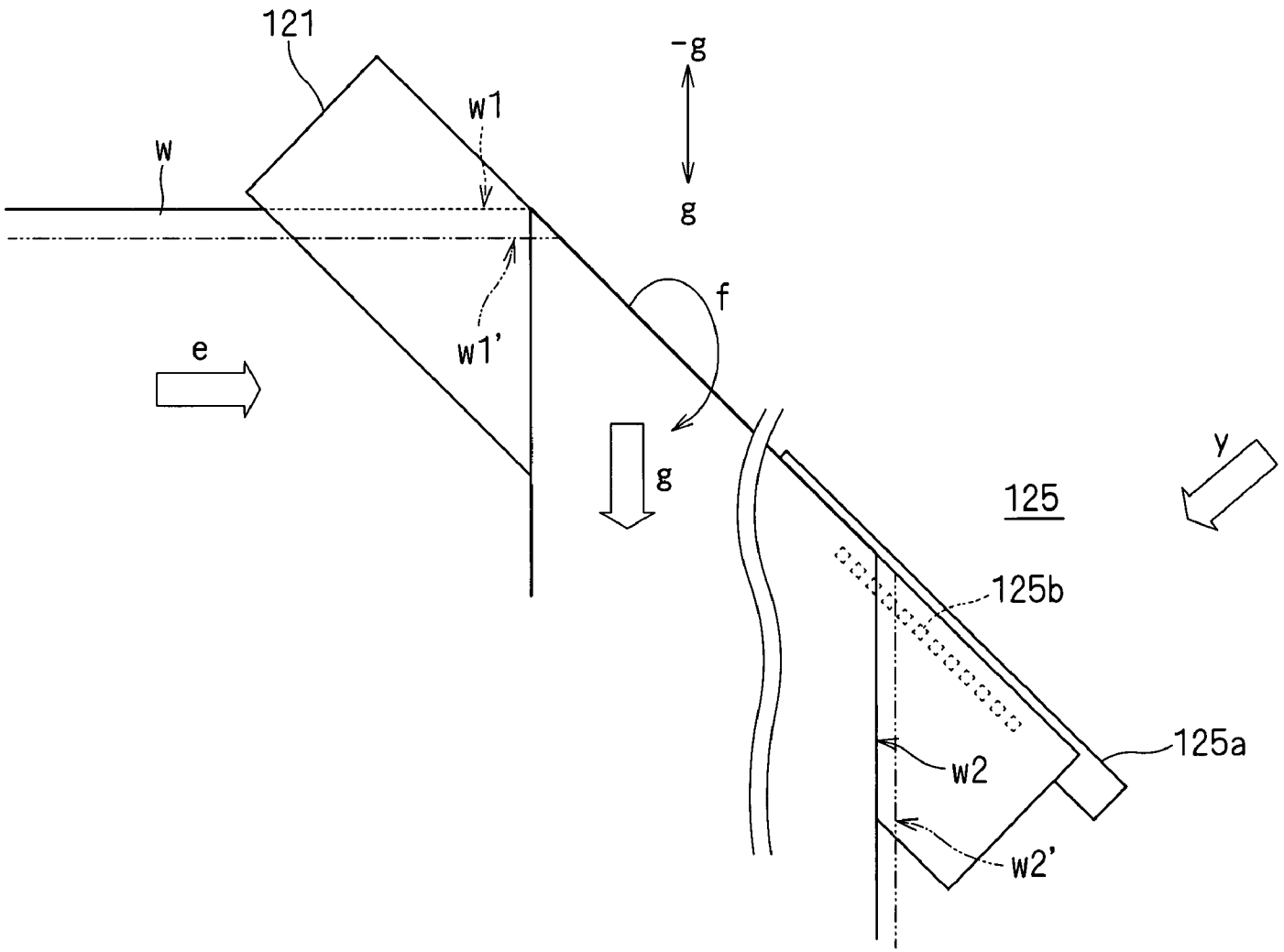
FIG. 17 is an enlarged top view of a turning bar in the ink jet printer according to the fourth preferred embodiment of the present invention.
Figure 18:
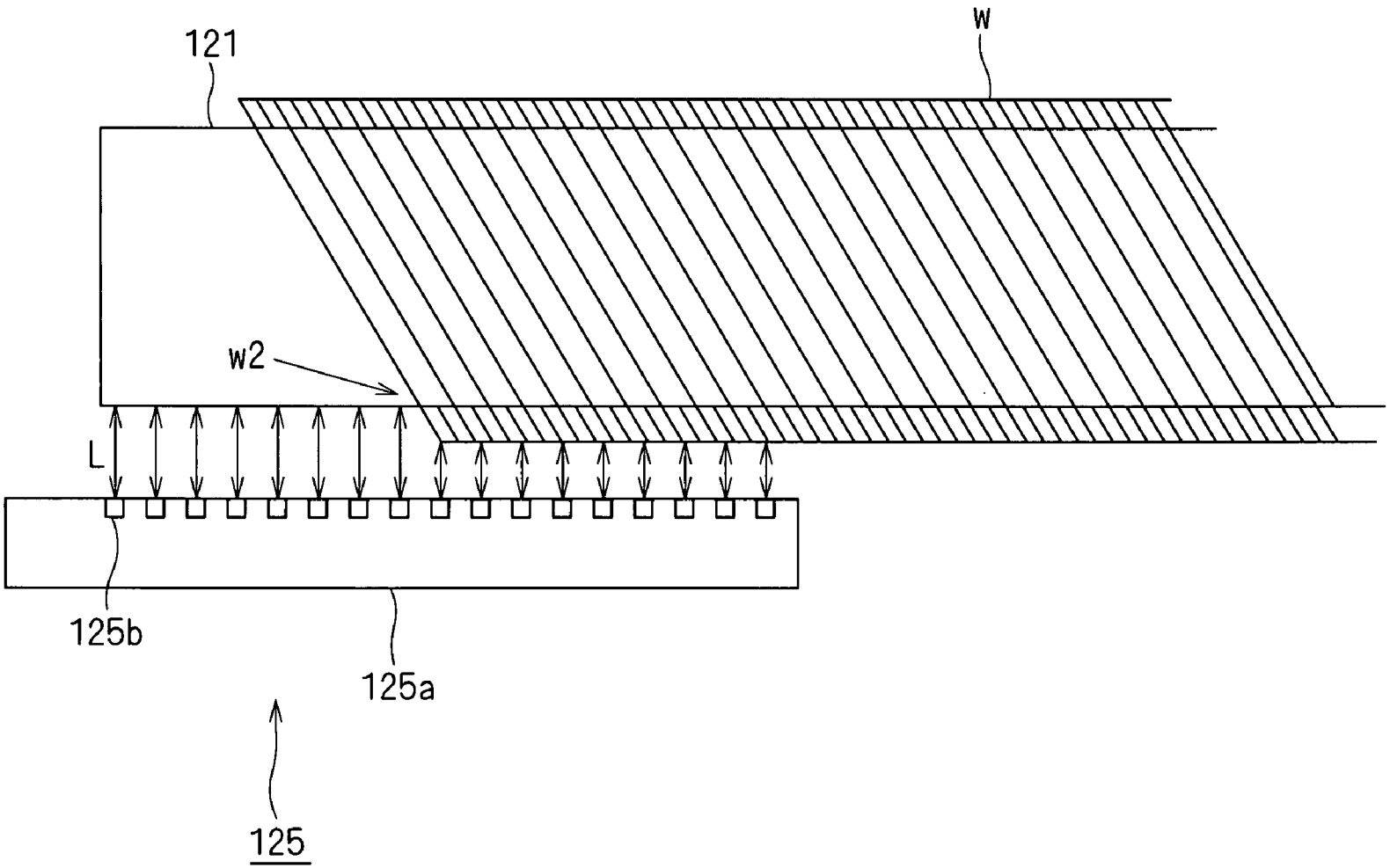
FIG. 18 is a side view showing, in an enlarged scale, the vicinity of the turning bar in the ink jet printer according to the fourth preferred embodiment of the present invention.

This will be described with reference to FIGS. 17 and 18. FIG. 17 is a top view of the turning bar 121. FIG. 18 is a side view showing the vicinity of one end of the turning bar 121, when viewed from the direction of the arrow y in FIG. 17. The thickness of the web w is exaggerated in FIG. 18. FIGS. 17 and 18 show that the web w traveling in the direction of the arrow e loops around the turning bar 121 from below (in the direction of the arrow f) and then starts to travel in another direction indicated by the arrow g.

As previously described, for compensation for the influence of shifting of the printing unit body 31, the ink jet printer according to the fourth preferred embodiment also actuates the first edge guide 10 to shift the web w which faces the first-side printing unit 33 in the direction of the web width. In the first and second preferred embodiments, the second edge guide 20 operates to prevent the control operation of the first edge guide 10 from exerting an influence on the downstream side. In this fourth preferred embodiment, the turning bar 121 instead of the second edge guide 20 is actuated so that even with the control operation of the first edge guide 10, the edge position of the web w on the downstream side can be kept at a fixed position. More specifically, as shown in FIG. 17, an edge sensor 125 is provided under the turning bar 121. The edge sensor 125 is mounted on the case of the ink jet printer and thus is not affected by the movement of the turning bar 121 in the g and −g directions. The edge sensor 125 includes a main body 125*a* and a plurality of light sensors 125*b* provided on the upper surface of the main body 125*a*. The light sensors 125*b* each consist of a light emitting element for emitting a sensing light L and a light receiving element for receiving a reflected light from an object. The light sensors 125*b* can determine an edge w2 of the web w, which loops around the turning bar 121, from a difference in reflectance between the web w and the turning bar 121.

Suppose that the edge of the web w is shifted from w1 to w1' by the operation of the first edge guide 10 as shown in FIG. 17. If the turning bar 121 is not movable, the edge w2 of the web w traveling in the direction of the arrow g from the turning bar 121 will be shifted to w2'. In the ink jet bar according to this preferred embodiment, in order to keep the edge position of the web w at w2, the turning bar 121 moves parallel in the direction of the arrow g. Here, the turning bar 121 moves in the opposite direction of the arrow g. A control circuit similar to the previously described second edge-guide servo circuit 27 performs feedback control to keep the edge position of the web w at a predetermined position w2, using the output of the edge sensor 125.

While the head edge sensor 35 reads the edge of the web w, it may read marks printed on one side of the web w described in the second preferred embodiment.

As so far described, in the ink jet printers according to the present invention, the printing unit (first-side printing unit 33) for printing on one side of a traveling web and the other printing unit (second-side printing unit 34) for printing on the other side of the web are located at the same position on the paths of travel of the web. Thus, when printing on one side of a wide web, these duplex printers do not require fine control such as delaying image data between the printing units. Besides, zigzag movement of the web w on the fourth transport path P4 can be handled by only shifting the printing unit body 31. Further, the influence that the shifting of the printing unit body 31 has on the first transport path P1 can be offset by the first edge guide 10 adjusting the position of the web w in the direction of the web width.

In the ink jet printers according to the present invention, the first edge guide 10 functions not only to correct zigzag movement of the web w on the first transport path P1, but also to offset zigzag movement of the web w on the fourth transport path P4. That is, the first edge guide 10 has a plurality of functions. This simplifies device configuration.

Further in the ink jet printers according to the present invention, it is not necessary to shift image data in the direction of the web width according to zigzag movement of the web w. This allows easy data processing.

Further in the ink jet printers according to the present invention, there is no need to provide a pair of edge guides for handling zigzag movement of a web on the fourth transport path P4. This further simplifies device configuration.

While the invention has been shown and described in detail, the foregoing description is in all aspects illustrative and not restrictive. It is therefore understood that numerous modifications and variations can be devised without departing from the scope of the invention.

What is claimed is:

1. A duplex printer comprising:

a first-side printing unit for printing on one side of a traveling web;

a second-side printing unit for printing on the other side of said web;

a displacement sensor for detecting the amount of displacement between said second-side printing unit and a web which faces said second-side printing unit;

a printing-unit shift mechanism for shifting said first-side printing unit and said second-side printing unit integrally in a direction orthogonal to a direction of travel of said web according to the amount of displacement detected by said displacement sensor; and a web control mechanism for shifting a web which faces said first-side printing unit in the direction orthogonal to the direction of travel of said web by an amount corresponding to the amount of shift caused by said printing-unit shift mechanism.

2. The duplex printer according to claim 1, wherein at least either one of said first-side printing unit and said second-side printing unit is an ink jet head.

3. The duplex printer according to claim 1, wherein said web control mechanism includes an edge guide.

4. The duplex printer according to claim 1, wherein said second-side printing unit is located downstream of said first-side printing unit with respect to the direction of travel of said web, and an edge guide for correcting shifting of a web caused by said web control mechanism is provided between said first-side printing unit and said second-side printing unit.

5. A duplex printer comprising:

a first-side printing unit for printing on one side of a traveling web;

a second-side printing unit for printing on the other side of said web;

a displacement sensor for detecting the amount of displacement between a mark printed on said web by said first-side printing unit and said second-side printing unit;

a printing-unit shift mechanism for shifting said first-side printing unit and said second-side printing unit integrally in a direction orthogonal to a direction of travel of said web according to the amount of displacement detected by said displacement sensor; and a web control mechanism for shifting a web which faces said first-side printing unit in the direction orthogonal to the direction of travel of said web by an amount corresponding to the amount of shift caused by said printing-unit shift mechanism.

6. The duplex printer according to claim 5, wherein at least either one of said first-side printing unit and said second-side printing unit is an ink jet head.

7. The duplex printer according to claim 5, wherein said web control mechanism includes an edge guide.

8. The duplex printer according to claim 5, wherein said second-side printing unit is located downstream of said first-side printing unit with respect to the direction of travel of said web, and an edge guide for correcting shifting of a web caused by said web control mechanism is provided between said first-side printing unit and said second-side printing unit.

* * * * *